US005123385A

United States Patent [19]

Sado et al.

[11] Patent Number: 5,123,385

[45] Date of Patent: Jun. 23, 1992

[54] DUAL OVERHEAD CAMSHAFT ENGINE CYLINDER HEAD STRUCTURE

[75] Inventors: Osamu Sado, Higashihiroshima; Kazuhiko Ueda, Hatsukaichi; Noriyuki Iwata, Hiroshima; Tatsuya Uesugi, Higashihiroshima; Shunji Masuda, Hiroshima, all of Japan

[73] Assignee: Mazda Motor Corporation, Hiroshima, Japan

[21] Appl. No.: 704,989

[22] Filed: May 24, 1991

[30] Foreign Application Priority Data

May 24, 1990 [JP] Japan ..... 2-54786[U]
May 25, 1990 [JP] Japan ..... 2-55099[U]
May 25, 1990 [JP] Japan ..... 2-55100[U]

[51] Int. Cl.[5] ..... F02M 25/00; F01L 1/00

[52] U.S. Cl. ..... 123/193.5; 123/572; 123/90.27; 123/90.34; 123/196 M

[58] Field of Search ..... 123/572, 193 H, 193 CH, 123/90.27, 90.31, 90.33, 90.34, 90.38, 195 C, 196 M

[56] References Cited

U.S. PATENT DOCUMENTS 4,517,951 5/1985 Otaka et al. ..... 123/572
4,603,673 8/1986 Hiraoka et al. ..... 123/572
4,709,667 12/1987 Ichihara et al. ..... 123/90.38
4,895,113 1/1990 Speir et al. ..... 123/90.31
4,915,066 4/1990 Koshimoto et al. ..... 123/90.34
4,955,335 9/1990 Jingu et al. ..... 123/90.33

*Primary Examiner*—E. Rollins Cross
*Assistant Examiner*—M. Macy
*Attorney, Agent, or Firm*—Fleit, Jacobson, Cohn, Price, Holman & Stern

[57] ABSTRACT

A cylinder head for a double overhead camshaft engine, with a plurality of intake valves and a plurality of exhaust valves for each cylinder, is covered by a cylinder head cover to support, for rotation, intake and exhaust camshafts. A hermetically sealed chamber, formed between the cylinder head and head cover as an oil jacket, is divided into two chambers, enclosing major parts of the intake and exhaust camshafts, respectively, which are in communication with each other near first ends of the chambers. An outlet hole is formed in the cylinder head cover so as to permit blow-by gas to flow out of the chamber. A cover, covering a gear train for operationally coupling the intake and exhaust camshafts, is bolted to one end of the head cover at several points around the gear train and to the cylinder head.

9 Claims, 7 Drawing Sheets

DUAL OVERHEAD CAMSHAFT ENGINE CYLINDER HEAD STRUCTURE

The present invention relates to a cylinder head structure for a dual or double overhead camshaft engine.

BACKGROUND OF THE INVENTION

1. Field of the Invention

Typically, a double overhead camshaft engine (referred to hereinafter as a DOHC engine) is provided with a pair of overhead camshafts for a row of cylinders. Such a pair of overhead camshafts usually includes an intake camshaft and an exhaust camshaft, which are arranged parallel to a crankshaft of the engine. One of the overhead camshafts, called a drive camshaft, is connected or coupled to the crankshaft by a belt which transmits the engine output to drive the drive camshaft The other of the overhead camshafts, called driven camshaft, is connected or coupled to the drive camshaft by transmission means, such as meshing camshaft gears secured to the drive and driven camshafts, respectively The transmission means transmits the rotation of the drive camshaft to drive the driven camshaft. To operate, or drive, valves with the overhead camshaft, a valve drive mechanism or valve train, including cams having cam lobes, is provided. Each cam lobe drives one valve.

2. Description of Related Art

A valve train such as that referred to above is known from, for instance, Japanese Unexamined Utility Model Publication No. 61- 171,807. Each valve drive mechanism of this publication cooperates with a hydraulic valve lash adjuster, which supports and urges a rocker arm disposed between a cam lobe of the overhead camshaft and a valve stem so as to maintain zero valve stem to rocker clearance. Such a hydraulic valve lash adjuster is described in, for example, Japanese Unexamined Utility Model Publication No. 55- 144803.

The drive overhead camshafts of the DOHC engine are supported for rotation by supporting means provided on a cylinder head. Camshaft supporting means of this kind typically comprise two bearing parts for supporting, for rotation, the camshafts therebetween. Such supporting means may include cam carrier means, provided separately from the cylinder head and bolted, or otherwise secured, to the cylinder head, and cap means, formed integrally with a cylinder head cover.

Since a camshaft drive mechanism as described above narrows a space between the drive and driven camshafts, a DOHC engine of this kind can be provided with a reduced width. On the other hand, the camshaft supporting means can be formed from a reduced number of parts and, consequently, allow the DOHC engine to be simple in structure.

In recent years, DOHC engines have typically been provided with a plurality of intake valves and a plurality of exhaust valves for each cylinder in order to increase intake charging efficiency and develop an increase in output power. Some DOHC engines of this kind have a different number of intake and exhaust valves for each cylinder.

The provision of a plurality of intake valves and a plurality of exhaust valves for each cylinder, and of an individual hydraulic valve lash adjuster for each valve, somewhat conflicts with a fundamental demand in car design for DOHC engines which are small in size. In particular, the cylinder head of a small DOHC engine must be formed with a plurality of bores and holes for installing the valves and valve trains, including the hydraulic valve lash adjusters, which unavoidably causes a decrease in structural rigidity of the DOHC engine body.

Oil, which lubricates the camshafts and valves and operates the hydraulic valve lash adjusters, scatters over a cylinder head during engine operation and produces oil mist. With an increase in the number of intake and exhaust valves and hydraulic valve lash adjusters, the quantity of oil mist on the cylinder head increases. Accordingly, blow-by gas, which is introduced into an oil separator, contains an increased quantity of oil mist, so that it is necessary to provide an oil separator of large capacity in order to process the blow-by gas efficiently. A large capacity oil separator necessarily occupies a large space, even though the DOHC engine is designed to be small in size.

In-mesh camshaft gears, for operationally coupling the drive and driven camshafts, are covered by a gear cover so as to prevent both foreign articles from being caught between the camshaft gears and lubrication oil from being scattered from the camshaft gears. In addition, the gear cover, if it is secured to the DOHC engine with the cam carrier means, is typically rigidly connected to the cam carrier means. For easy connection between the gear cover and cam carrier means, the gear cover is usually constructed as two parts which are separable in a direction parallel to the axis of the crankshaft. That is, the gear cover comprises a front cover section and a rear cover section formed integrally with the cam carrier means and bolted at several points around the peripheries of the camshaft gears or otherwise secured to each other, so as to enclose marginal portions of the camshaft gears.

To improve the rigidity of the camshaft supporting means and, in particular, parts of the camshafts near the camshaft gears, the cam carrier means is formed by radial bearing means and thrust bearing means. Since the camshaft gear has a diameter larger than diameters of the related camshaft and cam lobes, the camshaft gear projects downward on a side of the cylinder head. In order to eliminate an interference between the camshaft gear and an upper end of the cylinder head, the cylinder head is formed in an upper end portion with a recess for receiving lower parts of the in-mesh camshaft gears. That is, the in-mesh camshaft gears are accommodated in a space defined between the gear cover and the end recess.

Since it opens downward, the gear cover, or cover member, is low in rigidity. In addition, since the cover member is integral with the camshaft supporting means, it receives external loads from the camshafts, and is apt to cause a large, three dimensional deformation, owing to a change of torque of the camshafts, abnormal operations of the valve means, such as jumping and bouncing, or changes in angles of torsion of the camshafts, for example.

SUMMARY OF THE INVENTION

The primary object of the present invention is to provide a cylinder head structure for a double overhead camshaft engine, having a plurality of intake valves and a plurality of exhaust valves for each cylinder, which has a high structural rigidity.

Another object of the present invention is to provide a cylinder head structure for a double overhead camshaft engine, provided with a plurality of intake valves and a plurality of exhaust valves for each cylinder, with a bearing means which is free from deformation and potential seizing.

According to the present invention, the cylinder head structure for a double overhead camshaft engine, provided with a plurality of intake valves and a plurality of exhaust valves for each cylinder, includes a cylinder head block and a cylinder head cover mounted on the cylinder head block so as to support, for rotation, the intake and exhaust camshafts on the cylinder head block. The cylinder head block and cylinder head cover form therebetween a hermetically sealed chamber, creating an oil jacket. The cylinder head block is integrally formed with partition means, such as a lengthwise extending wall, for dividing the hermetically sealed chamber into two chambers enclosing major portions of the intake and exhaust camshafts, respectively. The chambers are in communication with each other near first ends of the chambers.

Outlet means, such as a hole, is formed in the cylinder head cover so as to permit blow-by gas to flow out the chamber enclosing the one of the intake and exhaust camshafts which drives either the intake valve, or valves, or the exhaust valve, or valves. The camshaft which is enclosed by the cylinder head cover including the outlet means is that one which drives the smallest number of valves per cylinder.

The outlet means is desirably located closer to a second end of the chamber in which it is formed than to a position at which the chambers are in communication with each other.

A cover means is bolted or otherwise secured to one end of camshaft carrier means, formed as the cylinder head cover, at a plurality of points around a gear train. Such a gear train may include a pair of gears in mesh with each other, coupled to first ends of the intake and exhaust camshafts so as to turn the intake and exhaust camshafts in opposite directions. The cover means has bearing means integrally formed inside thereof so as to support the intake and exhaust camshafts, thereby restricting movement of end portions of the intake and exhaust camshafts. The cover means further has reinforcing means, which may include a plurality of bosses for receiving bolts for fixing the cover means to the cylinder head, integrally formed outside thereof and extending along almost the whole vertical length of the cover means, for providing an increase in rigidity of the cover means.

The cylinder head is integrally formed with a boss which extends below the bearing means along the whole width of the cylinder head block and is formed with an oil passage.

BRIEF DESCRIPTION OF THE DRAWINGS

The above and other objects and features of the present invention will be apparent to those skilled in the art from the following detailed description of preferred embodiments thereof when considered in conjunction with the accompanying drawings, wherein similar reference numerals have been used to designate the same or similar elements throughout the drawings, and in which.

DETAILED DESCRIPTION OF THE PREFERRED EMBODIMENTS

Figure 1:
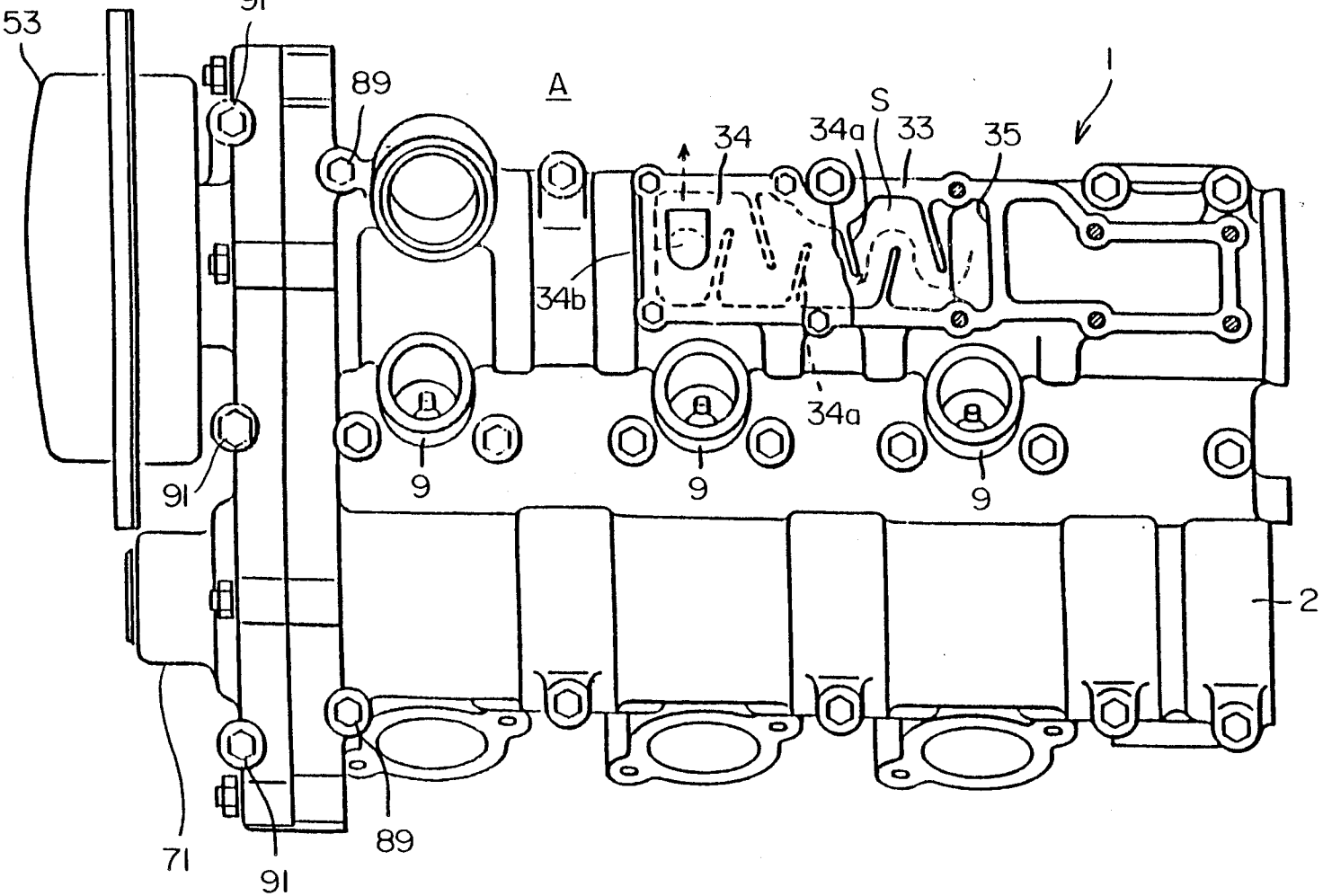
FIG. 1 is a plan view of a double overhead camshaft engine.
Figure 2:
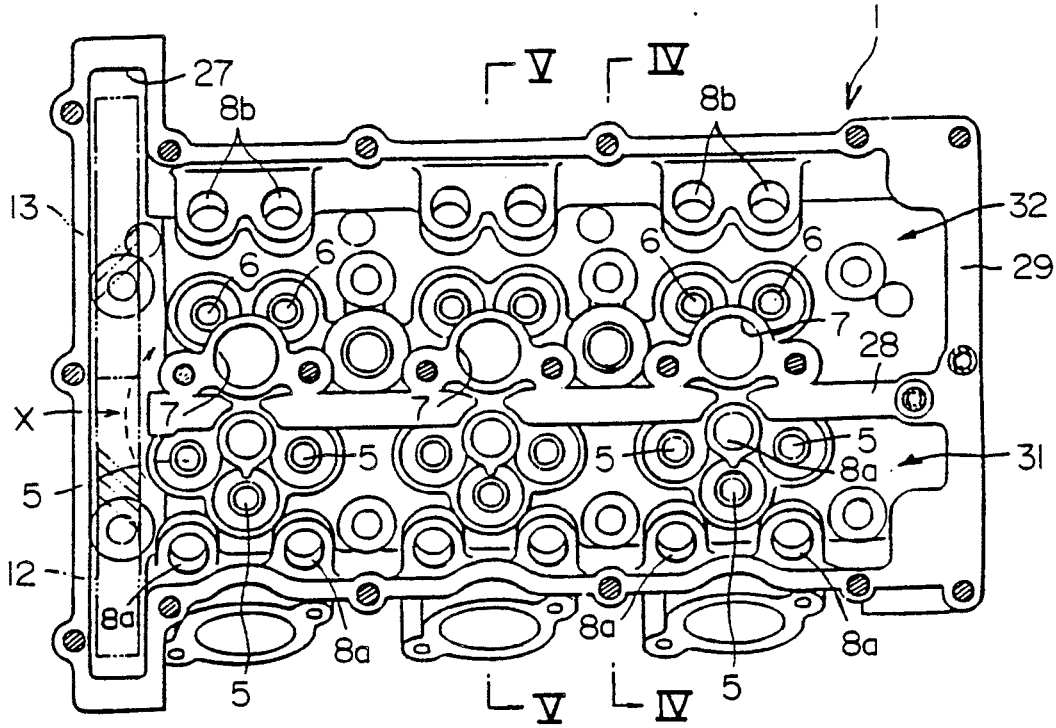
FIG. 2 is a plan view of a cylinder head structure in accordance with a preferred embodiment of the present invention which is disassembled from the double overhead camshaft engine of FIG. 1.

Referring to the drawings in detail and, in particular, to FIGS. 1 and 2, one of two cylinder heads 1 in accordance with a preferred embodiment of the present invention is shown. Each cylinder head 1 is mounted on one of left and right cylinder blocks (only one of which is shown), and is arranged in a V-formation, such that a predetermined relative angle, for example, a relative angle of 60 degrees, is formed between the heads. The cylinder heads and blocks form part of an overhead camshaft (DOHC) engine A, such as a V-6 DOHC engine, of the type having three intake ports and two exhaust ports for each cylinder (not shown). The cylinder head 1 is formed with various bores, such as three intake valve guide bores 5, two exhaust valve guide bores 6, one plug installation bore 7, three hydraulic valve lash adjuster installation bores 8*a* and two hydraulic valve lash adjuster installation bores 8*b* for each cylinder An intake camshaft 3, which is provided with one intake camshaft lobe 3*a* for each intake valve means, is supported on the cylinder head 1 for rotation by means of camshaft carrier means 2 and camshaft cover means 44, which will be described in detail later. Similarly, an exhaust camshaft 4, which is provided with one exhaust camshaft lobe 4*a* for each exhaust valve means, is supported on the cylinder head 1 for rotation by means of the camshaft carrier means 2 and camshaft cover means 44.

Figure 3:
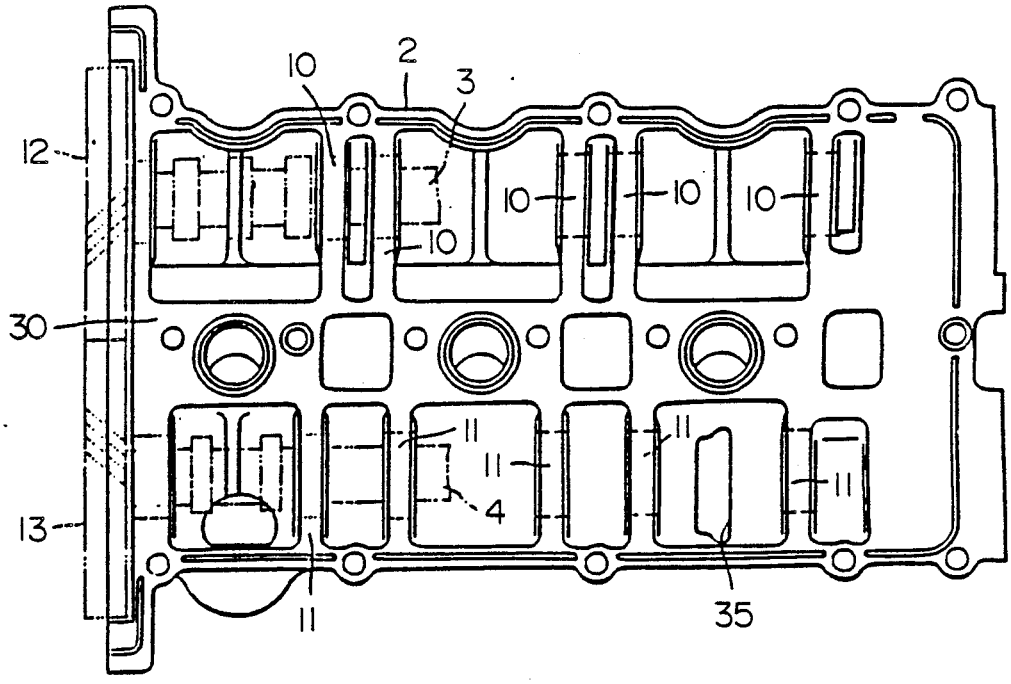
FIG. 3 is a bottom view of a cylinder head cover formed as camshaft carrier means.

Camshaft carrier means 2, constructed to serve as a cylinder head cover and cam cap, is mounted on the cylinder head 1. In an oil jacket, which is a space formed between the cylinder head 1 and cam carrier means 2 and will be described later, intake and exhaust overhead camshafts 3 and 4 are disposed so as to drive intake valves 18 and exhaust valves 19 (see FIG. 5). To support the overhead camshafts 3 and 4 for rotation, the camshaft carrier means 2 is integrally formed with bearing means. That is, the camshaft carrier means 2 is integrally formed with bosses 9 in alignment with the plug installation bores 7, respectively, which are in a row parallel to the row of the cylinders and extend upward from the upper surface thereof. As is shown in FIG. 3, the camshaft carrier means 2 is further integrally formed with a plurality of journal bearings 10 and 11, which are arranged in rows on opposite sides of the row of the bosses 9 inside the camshaft carrier means 2, so as to support, for rotation, the intake and exhaust overhead camshafts 3 and 4, respectively.

As is well known, the intake camshaft 3 is formed with a cam lobe for one intake valve 1B and is provided with a camshaft gear 12 secured to one end of the intake camshaft 3. The exhaust camshaft 4 is formed with a cam lobe for one exhaust valve 19 and is provided with a camshaft gear 13 secured to one end of the exhaust camshaft 4. These camshaft gears 12 and 13 are in mesh with each other in a gear chamber 27, formed at one end of the cylinder head 1. One of the camshafts 3 or 4 projects outside of the cylinder head 1 and is provided with a camshaft pulley (not shown), which is connected or coupled by a belt (not shown) to a crankshaft (not shown) of the engine A so as to transmit the engine output to the camshaft 3 or 4, thereby driving the camshafts 3 and 4 in opposite directions.

Figure 5:
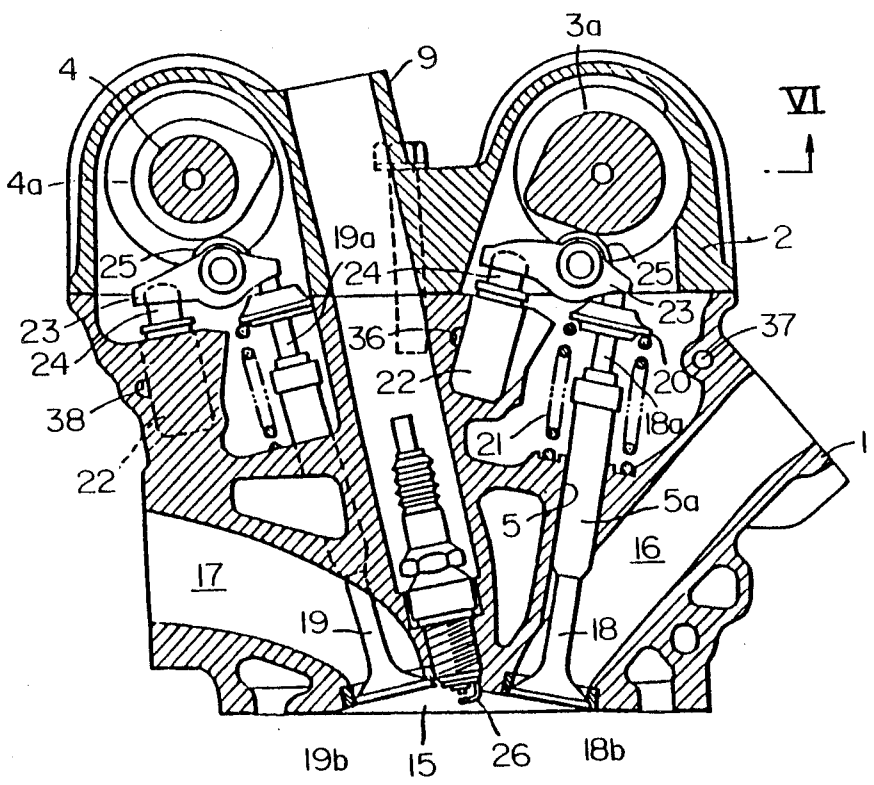
FIG. 5 is an enlarged cross-sectional view along line V—V of FIG. 2.
Figure 4:
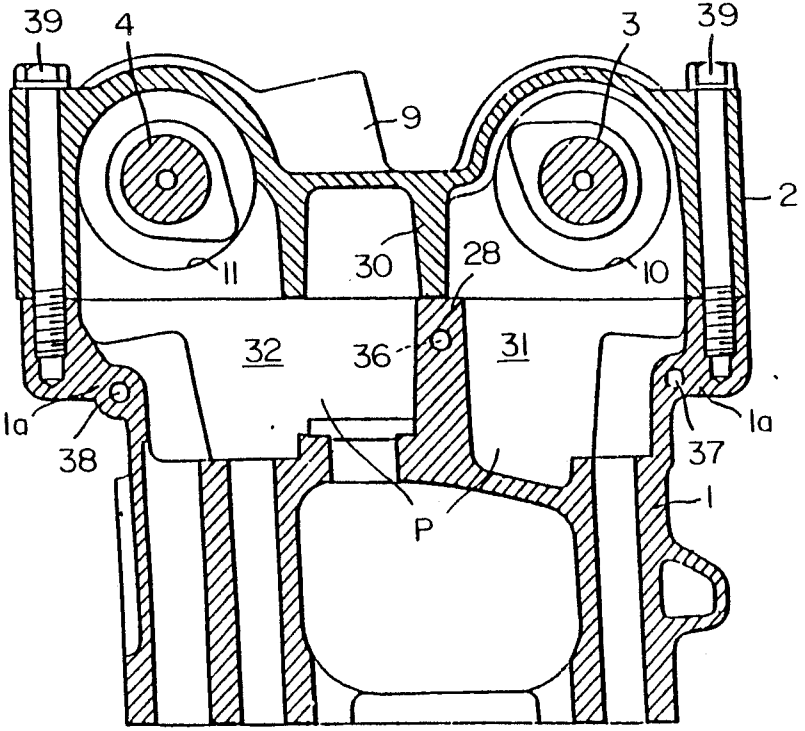
FIG. 4 is an enlarged cross-sectional view along line IV—IV of FIG. 2.

Referring to FIG. 5, the cylinder head 1 is provided with a combustion chamber 15 formed in each cylinder at a lower part of the cylinder head 1. The combustion chamber 15 is provided with three intake ports 16 for each cylinder, with openings which extend to one side of the cylinder head 1. Further, the combustion chamber 7 is provided with two exhaust ports 17 for each cylinder, with openings which extend to the opposite side of the cylinder head 1, remote from the intake ports 16. Each intake port 16, opening into the combustion chamber 15, is opened and shut at a predetermined timing by intake valve means 18. Each exhaust port 17, opening into the combustion chamber 15, is opened and shut at a predetermined timing by exhaust valve means 19.

Fuel mixture is introduced into the cylinder through the intake ports 16 while opened by the intake valve means 18, respectively. Then, after squeezing, or compressing, the fuel mixture in the cylinder, a spark plug 26 provides a spark inside the combustion chamber 15 so that the fuel mixture explodes. Thereafter, burned gases are blown out of the cylinder through the exhaust ports 17 while they are opened by the exhaust valve means 19.

Intake valve means 18, comprising a valve stem 18*a* and an intake valve 18*b* formed integrally with the intake valve stem 18*a*, is driven by a valve train. The valve train includes a valve spring 21 for urging the intake valve 18*b* in a direction such that the intake valve 18*b* opens the intake port 16, an intake valve guide sleeve 5*a* in the guide bore 5 for supporting the valve stem 18*a* for sliding movement, a rocker arm 23 with a roller 25 which is operated by an intake camshaft lobe 3*a* rubbing on, i.e., engaging, the roller 25 of the rocker arm 23, and a hydraulic valve lash adjuster 22. The hydraulic valve lash adjuster 22, which may be of any known type, is provided with a pivot 24, brought into contact with one end of the rocker arm 23 by hydraulic oil delivered through an oil passage 36 formed in the cylinder head 1, so as to maintain zero valve stem to rocker clearance. The intake valve means 1 is provided with a valve spring retainer 20 secured to an upper end portion of the valve stem 18*a*.

Similarly, the exhaust valve means 19, comprising a valve stem 19*a* and an intake valve 19*b* formed integrally with the intake valve stem 19*a*, is driven by a valve train which is the same in structure as the valve train of the intake valve.

As is apparent from the arrangement of the bores 5 and 8*a* shown in FIG. 2, the intake valve means 18 for each cylinder are located at points or vertices of a triangle so that two of the three intake valve means 18 are in a straight line extending in a lengthwise direction of the engine body A. The three hydraulic valve lash adjusters 22 of the intake valve means 18 for each cylinder are arranged in a triangular pattern surrounding the center intake valve means 18. Similarly, as is apparent from the arrangement of the bores 6 and 8*b* shown in FIG. 2, the exhaust valve means 19 are arranged in a row in a lengthwise direction of the engine body A, and the hydraulic lash valve adjusters 22 of the exhaust valve means 19 for the cylinders are arranged in a row parallel to the row of the exhaust valve means 19.

The difference in number between the intake and exhaust valve means 18 and 19 for each cylinder provides an available space between each adjacent cylinders which is smaller on a side of the intake valve means 18 than on a side of the exhaust valve means 19 Accordingly, a distance between adjacent journal bearings 10 for the intake camshaft 3 is smaller than a distance between adjacent journal bearings 11 for the exhaust camshaft 4

The cylinder head 1 is integrally formed with an elongated partition wall 28 between the row of the intake valve guide bores 5 and the row of the plug installation bores 7. The partition wall 28 is located in the transverse direction of the cylinder head 1 closer to the row of the intake valve guide bores 5 than to the row of the exhaust valve guide bores 6, and extends in the lengthwise direction of the cylinder head 1 from the gear chamber 27 to the rear end of a peripheral connecting wall 29. On the other hand, the camshaft carrier means 2 is integrally formed with an elongated partition wall 30, extending vertically downward, which abuts against an upper surface of the partition wall 28 of the cylinder head 1.

When assembling the camshaft carrier means 2 to the cylinder head 1 by bolts 39, the oil jacket P, defined between the cylinder head 1 and camshaft carrier means 2, is divided into two oil chambers 31 and 32 by means of the elongated partition walls 28 and 30 abutting against each other. Since the elongated partition wall 28 of the cylinder head 1 does not extend inside the gear chamber 27, the two oil chambers 31 and 32 communicate with each other through the gear chamber 27 as is shown by an arrow X in FIG. 2 In other words, the oil jacket P is formed as a U-shaped space between the cylinder head 1 and camshaft carrier means 2.

As is shown in FIG. 1, the camshaft carrier means 2 is formed with a rib 33, forming a space S therein, to which an oil separator 34 is bolted. A plurality of buffer ribs 34*a* are formed in the space S so as to provide a zigzag path for blow-by gas. Blow-by gas is introduced into the oil separator 34 from the oil jacket P through a blow-by gas inlet 35 formed in the camshaft carrier means 2. It is desired to locate the blow-by gas inlet 35 so as to open into the oil chamber 32 under the exhaust camshaft 4, which has a lower number of valves than the intake camshaft 3, and so as to be far away from the gear chamber 27 of the cylinder head 1 in the lengthwise direction. First to third oil passages 36, 37 and 38 for supplying oil to the hydraulic valve lash adjusters 22 are formed in the elongated partition wall 28 and side ribs 1*a* of the cylinder head 1, respectively.

Figure 6:
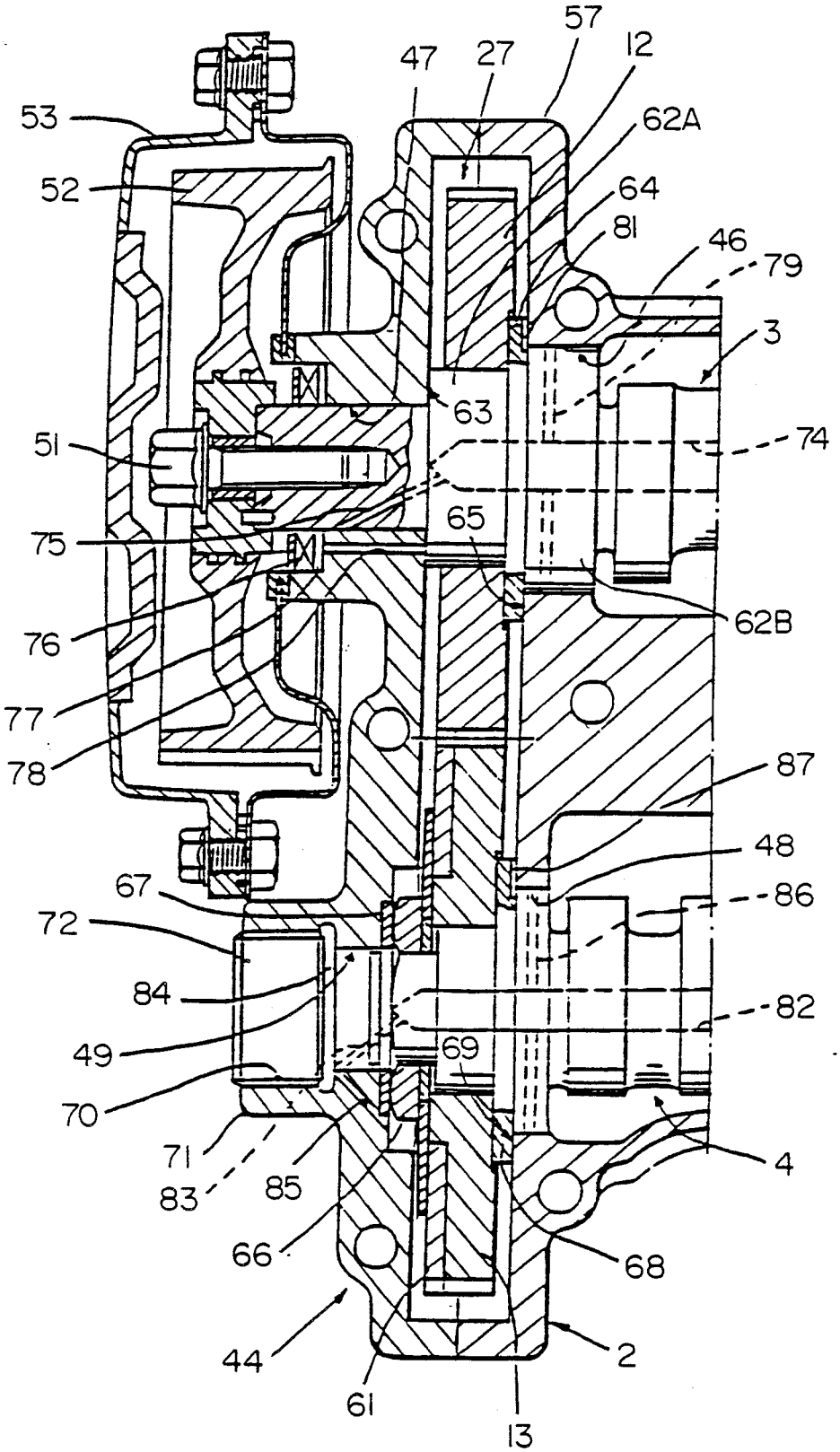
FIG. 6 is an enlarged cross-sectional view along line VI—VI of FIG. 5.

Referring to FIG. 6, the intake camshaft 3 extends in a lengthwise direction of the cylinder head 1 (from the right or front to the left or rear in FIG. 6) so as to be parallel with the crankshaft of the engine and is supported for rotation by a radial bearing portion 46 formed integrally with the camshaft carrier means 2 and a radial bearing portion 47 formed integrally with the camshaft cover means 44. Similarly, the exhaust camshaft 4 extends in the lengthwise direction so as to be parallel with the crankshaft and, hence, the intake camshaft 3, and is supported for rotation by a radial bearing portion 48 formed integrally with the camshaft carrier means 2 and a radial bearing portion 49 formed integrally with the camshaft cover means 44.

The front end of the intake camshaft 3 is provided with a timing pulley 52 secured thereto by a bolts 51. This pulley 52 is connected or coupled to the crankshaft by a belt (not shown) which transmits the engine output to drive the pulley 52 at a speed of one-half that of the crankshaft. The pulley 52 is protected by a pulley cover 53. The intake camshaft gear 12 of the intake camshaft 3, located slightly rearward of the pulley 52, and the exhaust camshaft gear 13, provided near the front end of the exhaust camshaft 4, are in mesh with each other so as to rotate at the same speed but in the opposite directions. In order to eliminate backlash of the exhaust camshaft gear 13, a gear 61 is provided so as to mesh with the intake camshaft gear 12 and be displaceable with respect to the exhaust camshaft gear 13. These camshaft gears 12 and 13 are enclosed within the gear chamber 27 defined between the cylinder head 1 and camshaft carrier means 2 and, particularly, by the camshaft cover means 44, a gear casing portion 57 formed as a front end portion of the camshaft carrier means 2 and a groove 58 (see FIG. 7) formed in a front upper portion of the cylinder head 1.

The intake camshaft 3 has a front journal 62A which supports the intake camshaft gear 12 in the gear chamber 27 having a diameter larger than that of the front end portion of the intake camshaft 3. A front surface of the front journal 62A slidably abuts against a rear thrust surface 63 of the boss of the camshaft cover means 44, which serves as a part of a thrust bearing means. The intake camshaft 3 is provided behind the front journal 62A of the intake camshaft 3 with a thrust collar 64 having a diameter larger than that of the front journal 62A of the intake camshaft 3. The thrust collar 64 slidably abuts against a front thrust surface 65 of the boss of the camshaft carrier means 2 which serves as another part of the thrust bearing means. The thrust bearing means, comprising the front and rear thrust surfaces 63 and 65, supports the intake camshaft 3 so as to prevent a thrust movement of the intake camshaft 3. The intake camshaft 3 is further formed behind the thrust collar 64 with a rear journal 62B having a diameter between those of the front journal 62A and the thrust collar 64. A peripheral surface of the rear journal 62B is surrounded by an inner surface of a bore 46, serving as radial bearing means, formed in the boss of the camshaft carrier means 2.

Exhaust camshaft 4 is provided with a lock nut 66, secured thereto behind the exhaust camshaft gear 13. The lock nut 66 slidably abuts against a rear thrust surface of a front thrust metal insert or washer 67, embedded in the camshaft cover means 44, which serves as a part of the thrust bearing means. The exhaust camshaft 4 is further provided behind the exhaust camshaft gear 13 with a thrust collar 68, slidably abutting against a front thrust surface 69 of the boss of the camshaft carrier means 2, which serves as another part of the thrust bearing means. The thrust bearing means, comprising the front thrust metal insert 67 and the thrust collar 68, supports the exhaust camshaft 4 so as to prevent a thrust movement of the exhaust camshaft 4. The camshaft cover means 44 has a front end boss 71 formed with a bore 70 having an internal thread. A plug 72 is screwed into the bore 70.

The cylinder head 1 is further formed in its upper portion with the first to third oil passages 36, 37 and 38 for delivering hydraulic oil to the hydraulic valve lash adjuster 22. In more detail, the first oil passage 36 initially extends in the lengthwise direction so as to be in communication with the hydraulic valve lash adjusters 22 for the intake valve means 18 and then turns upwards just before the groove 58 so as to open to the upper surface of the cylinder head 1. The second oil passage 37 initially extends parallel with the first oil passage 36 in the lengthwise direction so as to be in communication with the hydraulic valve lash adjuster 22 for the center intake valve means 18 and then turns upwards just before the groove 58 so as to open to the upper surface of the cylinder head 1. The third oil passage 38 initially extends parallel with the first and second oil passages 36 and 38 in the lengthwise direction so as to be in communication with the hydraulic valve lash adjusters 22 for the exhaust valve means 19 and then turns upwards just before the groove 58 so as to open to the upper surface of the cylinder head 1.

Figure 7:
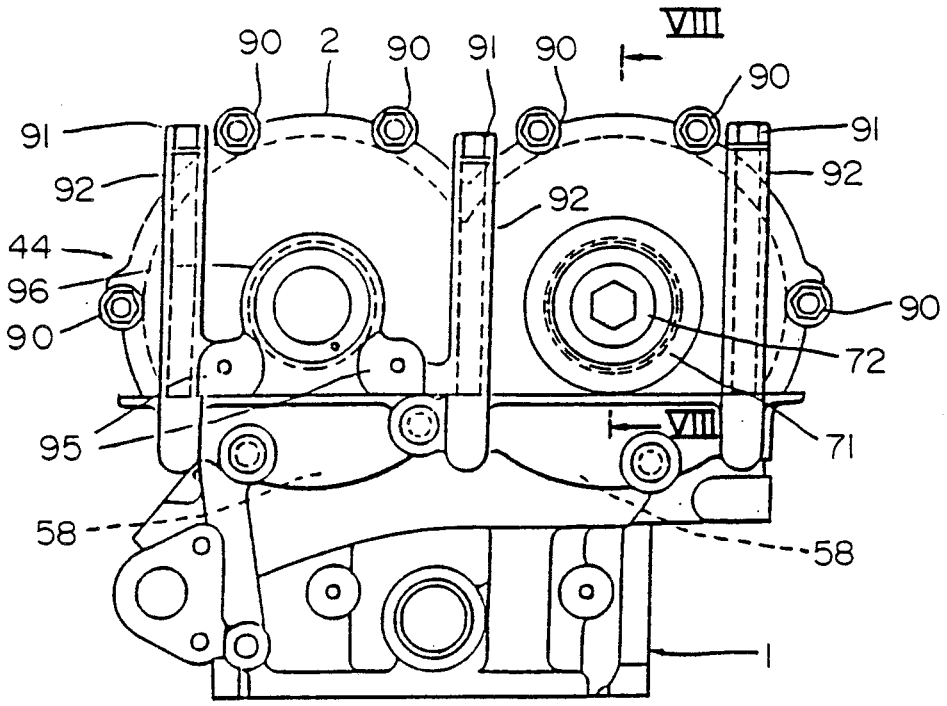
FIG. 7 is a front view of the double overhead camshaft engine of FIG. 1.
Figure 8:
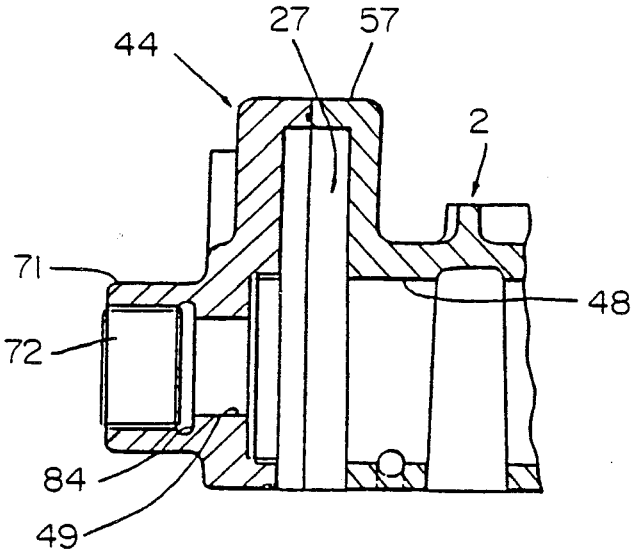
FIG. 8 is a cross-sectional view along line VI—VI of FIG. 7.

Referring to FIGS. 1, 7 and 8, the camshaft carrier means 2, formed with the radial bearing means 46 and 48 for the intake and exhaust camshafts 3 and 4, respectively, and the gear casing portion 57, is mounted and bolted by a plurality of bolts 89 onto the cylinder head 1. The camshaft cover means 44 is attached and bolted at several points around the peripheries of the camshaft gears 12 and 14 to the upper front end of the camshaft carrier means 2 by a plurality of bolts 90 so as to support the front ends of the intake and exhaust camshafts 3 and 4 and cover the intake and exhaust camshaft gears 12 and 13. The rear end portion of the camshaft cover means 44 is shaped to conform to the gear casing portion 57 of the camshaft carrier means 2. As was previously described, the camshaft cover means 44, gear casing portion 57 of the camshaft carrier means 2 and the groove 58 form therebetween the gear chamber 27 for receiving therein the intake and exhaust camshaft gears 12 and 13.

The camshaft cover means 44 is formed on its front end with vertically extending bosses 92 having an internal thread. Bolts 91 are threaded in these internally threaded bosses 92 to secure the camshaft cover means 44 to the cylinder head 1. The vertically extending bosses 92 increase the rigidity of the camshaft cover means 44.

Figure 10:
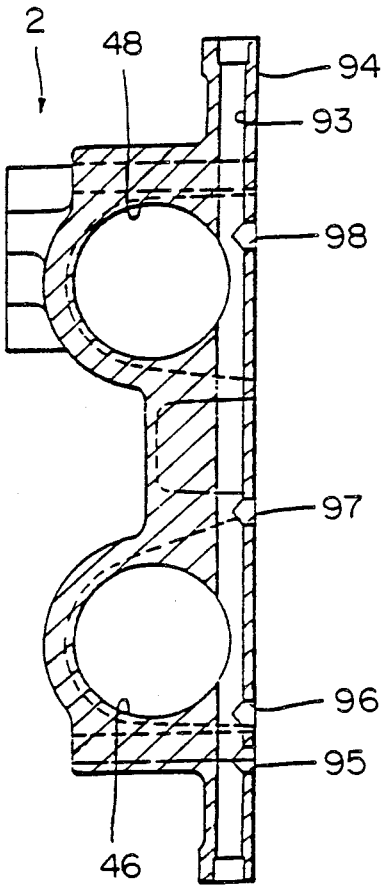
FIG. 10 is a cross-sectional view along line X—X of FIG. 9.
Figure 9:
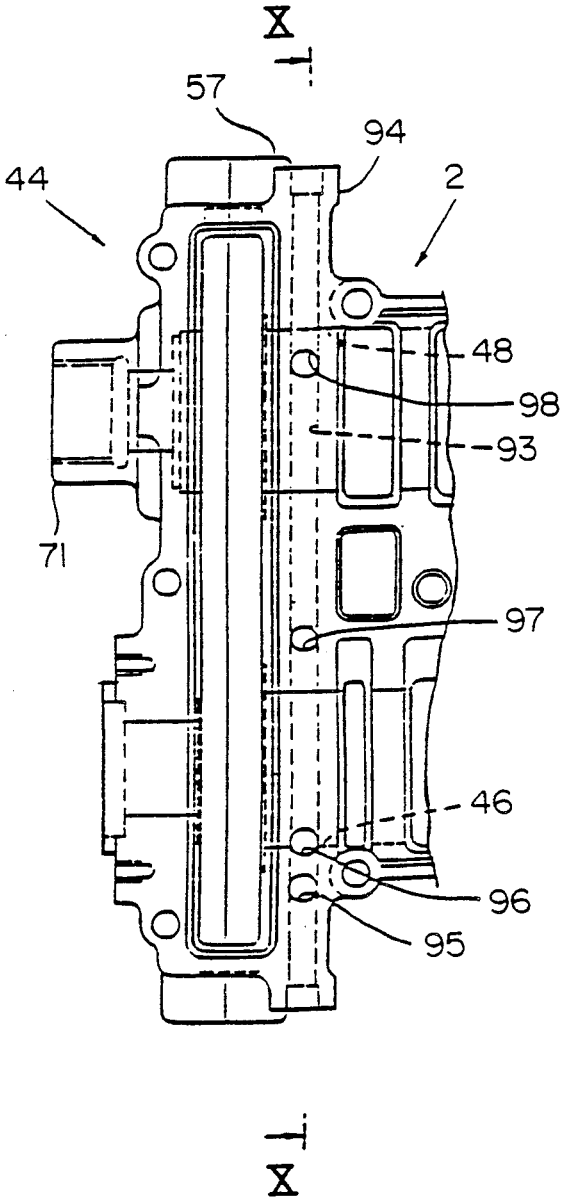
FIG. 9 is an enlarged plan view of a front part of the cylinder head cover shown in FIG. 3.

Referring to FIGS. 9 and 10, the camshaft carrier means 2 is formed with an oil passage 93 extending transversely behind the gear casing portion 57 and below the radial bearing means 46 and 48 for the intake and exhaust camshafts 3 and 4 so as to be in communication with the radial bearing means 46 and 48. The oil passage 93 is formed in a transverse boss 94 extending along the whole width of the gear casing portion 57 of the camshaft carrier means 2. The transverse boss 94 thus formed functions as a beam to provide an increase in the rigidity of the radial bearing means 46 and 48 for the intake and exhaust camshafts 3 and 4, so that the radial bearing means 46 and 48 are free from deformation due to thrust loads. This structure, which causes no deformation of the radial bearing means 46 and 48, prevents an increase in resistance to sliding movement of the radial bearing means 46 and 48 and the occurrence of seizing in the radial bearing means 46 and 48. Furthermore, since the camshaft carrier means 2 is improved in rigidity at, in particular, the front end portion, the camshaft cover means 44, connected to the camshaft carrier means 2, is improved in rigidity.

Lubrication oil is delivered into the oil passage 93 from an oil gallery P provided between the cylinder head 1 and camshaft carrier means 2 through a main oil passage 95. A part of the lubrication oil in the oil passage 93 is introduced toward the radial bearing means 46 and 48 and then toward camshaft journal bearings 10 and 11 through axial oil passages 74 and 82 formed in the intake and exhaust camshafts 3 and 4, respectively. The oil passage 93 is formed with first to third branch oil passages 96, 97 and 98, branching off downward therefrom, which are brought into communication with the first to third oil passages 36, 37 and 38, respectively, when the camshaft carrier means 2 is bolted to the cylinder head 1. A part of the oil in the oil passage 93 is supplied downward to the hydraulic valve lash adjusters 22 through the branch oil passages 96, 97 and 98 and the first to third oil passages 36, 37 and 38.

Referring again to FIG. 6, a branch oil passage 75, branching off from the intake camshaft oil passage 74, extends to a radial bearing 47. A part of the oil passed through the branch oil passage 75 is delivered to the front thrust surface 63 and the other is discharged into an annular space 77 formed between the camshaft cover means 44 and an oil seal ring 76. A return oil passage 78 is formed in the camshaft cover means 44 so as to axially extend from the space 77 and return the oil in the space 77 to the front thrust surface 63. The provision of these oil passages 75 and 78 sufficiently lubricates the front thrust surface 63.

The intake camshaft 3 is further formed with a radial oil passage 79 extending from the axial oil passage 74 and opening to the outer surface of the rear journal 62B. The radial oil passage 79 is axially located in a position closer to the front end of the rear journal 62B than to the rear end of the rear journal 62B. A part of the oil passing in the axial oil passage 74 is delivered to the radial bearing means 46 through the radial oil passage 79. The radial oil passage 79, located closer to the front end of the rear journal 62B, allows the major part of lubrication oil passed throughout the radial oil passage 79 to flow towards the rear thrust surface 65, so as to lubricate sufficiently the rear thrust surface 65. After the lubrication of the rear thrust surface 65, the oil is returned through a groove 81 formed in the thrust collar 64.

Similarly, a branch oil passage 83, branching off from the exhaust camshaft oil passage 82, extends to a radial bearing 49, so as to lubricate the radial bearing portion 49. A part of the oil passed through the branch oil passage 83 enters into an undercut groove 84 formed inside the internal thread bore 70, and then is returned through a return oil passage 85 so as to lubricate the front thrust metal insert 67 and the friction gear 61. The exhaust camshaft 4 is further formed with a radial oil passage 86 extending from the axial oil passage 82 and opening to the outer surface of the rear journal 48. A part of oil passing in the axial oil passage 82 is delivered to the radial bearing means 48 through the radial oil passage 86. After the lubrication of the rear radial bearing means 48, the oil is forced towards the front thrust surface 69, so as to lubricate sufficiently the front thrust surface 69.

Figure 11:
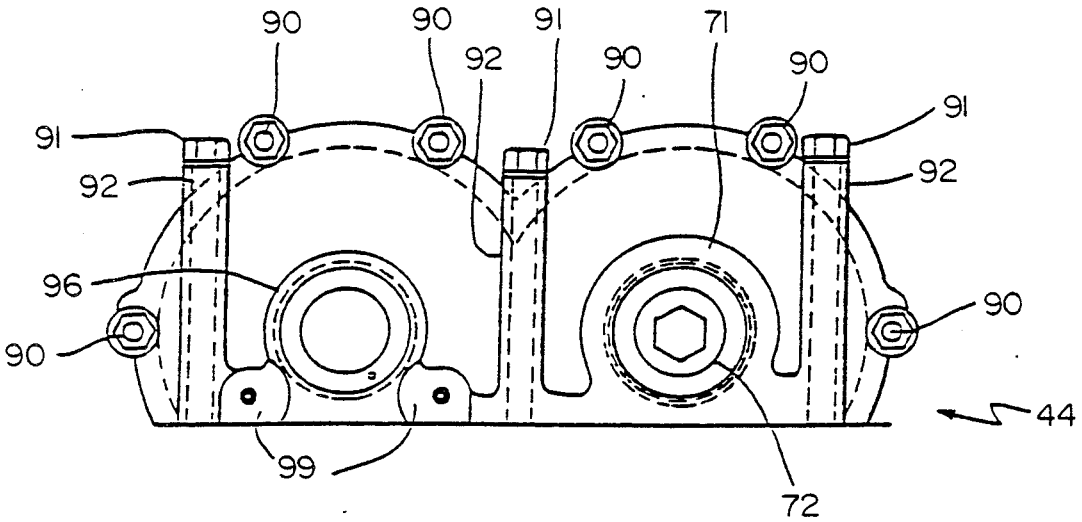
FIG. 11 is a front view showing a variant of camshaft supporting means of the double overhead camshaft engine of FIG. 1.

Referring to FIG. 11, showing a variant of the cylinder head structure of the preferred embodiment of the invention, the bosses 92 located on opposite sides of the exhaust camshaft 4 may be formed integrally with the front end boss 71 having a bore 70 of the camshaft cover means 44. This provides an increase in rigidity of that part surrounding the exhaust camshaft 4 of the camshaft cover means 44.

Figure 12:
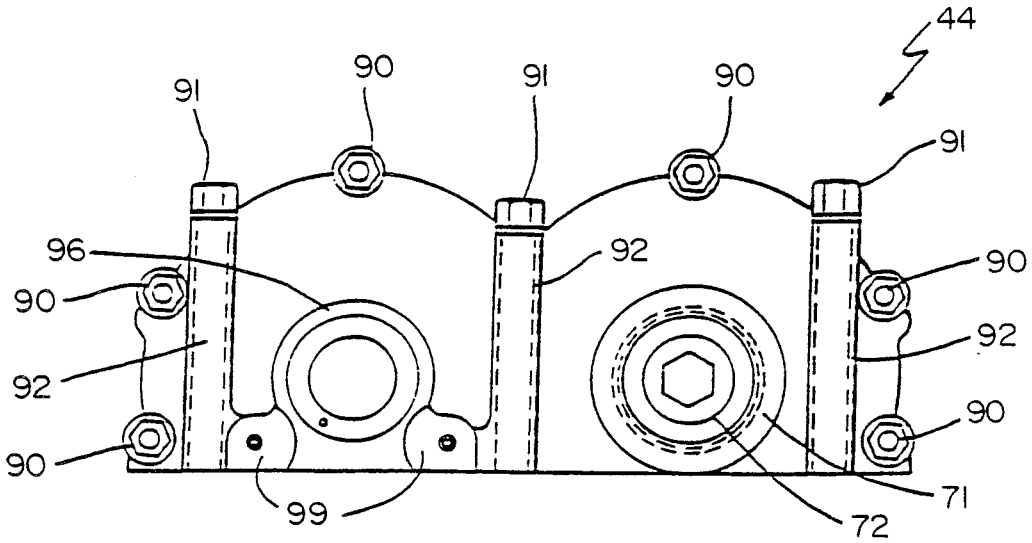
FIG. 12 is a front view showing another variant of camshaft supporting means of the double overhead camshaft engine of FIG. 1.

Referring to FIG. 12, showing another variant of the cylinder head structure of the preferred embodiment of the invention, the camshaft cover means 44 is provided with two connecting bolts 90 on each side of the cylinder head. This provides an increase in rigidity of both sides of the camshaft cover means 44.

As is apparent from the above description, although the cylinder head 1 has a large number of bores and holes formed therein, the provision of the elongated partition wall 28 between the rows of bores 5 and **8*a* and the rows of bores 6 and 8*b* provides an increase in structural rigidity, torsional strength and bending strength of the cylinder head 1**. Accordingly, even though the cylinder head is made small in size, a lack of rigidity is not caused.

While the engine A is in operation, blow-by gas, which escapes from the combustion chambers 15 into the oil jacket P above the cylinder head 1, is introduced into the oil separator 34 through the blow-by gas inlet 35 formed in the camshaft carrier 2. The blow-by gas flows in the oil separator 34 through the zigzag path in the space S and is discharged into an intake manifold (not shown) through a blow-by gas outlet **34*b* of the oil separator 34 after the elimination of oil mist by the buffer ribs 34*a***.

It is generally understood that as the number of valves and hydraulic valve lash adjusters for each cylinder becomes larger, the quantity of lubrication oil and working oil for the valve trains and hydraulic valve lash adjusters which is scattered and sprayed over the upper surface of the cylinder head 1 increases.

However, with a cylinder head 1 constructed as described above, since the U-shaped space P is formed between the cylinder head 1 and the camshaft carrier means 2 and is communicated with the zigzag path of the oil separator 34 by the blow-by gas inlet 35 at a location far away from the gear chamber 27, blow-by gas travels a long distance to the oil separator 34. Accordingly, if there is a large quantity of oil mist on the upper surface of the cylinder head 1, the oil mist conveyed by blow-by gas adheres to surfaces of the cylinder head I and the camshaft carrier means 2 while the blow-by gas travels through the U-shaped path, so that removal of oil mist is fostered and the blow-by gas, with a low content of oil mist, flows into the oil separator 34.

More oil mist is produced in the oil chamber 31 on the same side as the intake valves, which are provided in a number larger than the number of the exhaust valves, than in the oil chamber 32 on the same side as the exhaust valves. However, since the blow-by gas inlet 35 is located on the same side as the oil chamber 32, in which less oil mist is produced, blow-by gas in the oil chamber flows in a long path, from the oil chamber 31 to the blow-by gas inlet 35 through the oil chamber 32, until it enters the oil separator 34, so as to remove oil mist effectively. This makes it possible to install a low capacity oil separator in the engine A to process sufficiently the blow-by gas.

The vertically extending bosses 92 of the camshaft cover means 44 serve as reinforcement beams. Two of the vertically extending bosses 92 and an oil sealing boss 96 are connected by puller fitting bosses 95. Accordingly, the camshaft cover means 44 is greatly strengthened in rigidity, so that if the ends of the intake and exhaust camshafts 3 and 4 receive an external load, the camshaft cover means 44 is free from deformations in axial and transverse directions. A great increase in rigidity of the whole structure of the camshaft cover means 44 allows the use of not only smaller but also fewer bolts for firmly, liquid-tightly connecting the camshaft cover means 44 and the gear casing portion 57 of the camshaft carrier means 2.

Because the bosses 92 are located on opposite sides of the bearings 47 and 63 for the intake camshaft 3 and the bearings 49 and 67 for the exhaust camshaft 4, the gear casing portion 57 of the camshaft carrier means 2 is reinforced in structural rigidity by the camshaft cover means 44. Accordingly, the intake and exhaust camshafts 3 and 4 are firmly supported for rotation by the bearings 47, 49, 63 and 67, so as to be prevented from producing vibration and noise.

Since the oil passage boss 94, extending in the transverse direction of the cam carrier means below the intake and exhaust camshaft bearing means 46 and 48, serves as a transverse beam, an increase in structural rigidity of the end portion, including the camshaft bearing means 46 and 48 of the camshaft carrier means 2, is provided. Accordingly, if the ends of the intake and exhaust camshafts 3 and 4 receive an external load, an end portion, including the camshaft bearing means 46 and 48 of the camshaft carrier means 2, is free from deformations in axial and transverse directions, and an increase in friction and seizing in the camshafts bearing means 46 and 48 is prevented.

Since oil is delivered into the first to third oil passages 36, 37 and 38, branching off from the oil passage 93 and located above the cylinder head 1, the first to third oil passages 36, 37 and 38 are always filled with oil. Accordingly, even if an oil pump (not shown) does not operate immediately after the start of the engine, the hydraulic valve lash adjusters 22 are supplied with oil. Further, even if air mixes into the oil in the first to third oil passages 36, 37 and 38 during the operation of engine, the air bubbles rise quickly into the oil passage 93, and air is prevented from entering into the hydraulic valve lash adjusters 22.

What is claimed is:

1. A cylinder head structure for a double overhead camshaft engine, provided with a plurality of intake valves and a plurality of exhaust valves for each cylinder, the number of intake valves being different from the number of exhaust valves, the intake and exhaust valves being driven by intake and exhaust camshafts, respectively, said cylinder head structure comprising:

a cylinder head block;

a cylinder head cover mounted on said cylinder head block so as to support, for rotation, the intake and exhaust camshafts on said cylinder head block;

a hermetically sealed chamber formed between said cylinder head block and said cylinder head cover; and partition means for dividing said hermetically sealed chamber into two chambers partly enclosing the intake and exhaust camshafts, respectively, said chambers being in communication with each other near first ends of said chambers, said cylinder head cover including outlet means formed therein so as to permit blow-by gas to flow out one of said chambers enclosing one of said intake and exhaust camshafts, the one of said intake and exhaust camshafts being a camshaft which drives the smallest number of said intake and exhaust valves for a given cylinder.

2. A cylinder head structure as defined in claim 1, wherein said outlet means comprises a hole located closer to a second end of said one chamber than to a position at which said chambers are in communication with each other.

3. A cylinder head structure for a double overhead camshaft engine, comprising:

a cylinder head block;

an intake camshaft mounted on said cylinder head block;

an exhaust camshaft mounted on said cylinder head block;

a pair of gears for coupling said intake and exhaust camshafts so as to turn them in opposite directions;

cam carrier means mounted on said cylinder head block so as to support for rotation said intake and exhaust camshafts;

cover means secured to one end of said cam carrier means at a plurality of points around said pair of gears so as to cover said pair of gears;

bearing means formed on said cover means for supporting said intake and exhaust camshafts so as to restrict movement of end portions of said intake and exhaust camshafts; and reinforcing means integrally formed on said cover means and extending along almost the whole vertical length of said cover means for providing an increase in rigidity of said cover means.

4. A cylinder head structure as defined in claim 3, wherein said bearing means comprises a radial bearing and a thrust bearing for supporting each of said intake and exhaust camshafts.

5. A cylinder head structure as defined in claim 3, wherein said reinforcing means comprises a plurality of bosses integrally formed on one surface of said cover means, said cover means being secured through said bosses to said cylinder head block.

6. A cylinder head structure as defined in claim 5, wherein each of said bosses is formed with a vertical bore through which a bolt is passed so as to secure said cover means to said cylinder head block.

7. A cylinder head structure for a double overhead camshaft engine, comprising:

a cylinder head block;

an intake camshaft mounted on said cylinder head block;

an exhaust camshaft mounted on said cylinder head block;

coupling means installed between first ends of said intake and exhaust camshafts for operationally coupling said intake and exhaust camshafts so as to turn said intake and exhaust camshafts in opposite directions;

cam carrier means mounted on said cylinder head so as to support, for rotation, said intake and exhaust camshafts, said cam carrier means being formed with bearing means near said coupling means: and a boss extending below said bearing means along the whole width of said cylinder head block, said boss being formed with an oil passage.

8. A cylinder head structure as defined in claim 7, wherein said bearing means comprises a thrust bearing.

9. A cylinder head structure as defined in claim 8, wherein said bearing means further comprises another thrust bearing.

* * * * *